United States Patent [19]

Coffey et al.

[11] Patent Number: 4,700,171

[45] Date of Patent: Oct. 13, 1987

[54] IGNITION WIRE

[75] Inventors: Ronald J. Coffey, Lafayette; Christo M. Wassouf, West Lafayette, both of Ind.

[73] Assignee: United Technologies Corporation, Hartford, Conn.

[21] Appl. No.: 938,104

[22] Filed: Dec. 4, 1986

[51] Int. Cl.[4] ..... H01C 3/06

[52] U.S. Cl. ..... 338/214; 174/102 SC; 174/120 SC; 338/66

[58] Field of Search ..... 338/66, 214; 174/102 SC, 105 SC, 106 SC, 120 SC, 113 C, 131 A; 252/511

[56] References Cited

U.S. PATENT DOCUMENTS

| | | | |
|---|---|---|---|
| 3,284,751 | 11/1966 | Barker et al. | 338/214 |
| 3,870,987 | 3/1975 | Wiley et al. | 338/214 |
| 4,209,425 | 6/1980 | Lini et al. | 174/120 SC |
| 4,260,661 | 4/1981 | Walters et al. | 174/110 PM |
| 4,435,692 | 3/1984 | Miyamoto et al. | 338/214 |

*Primary Examiner*—C. L. Albritton

*Attorney, Agent, or Firm*—Harry J. Gwinnell

[57] ABSTRACT

Automotive ignition wire with a high temperature rating, excellent electrical insulating properties, heat resistance, oil resistance and abrasion resistance is described. The wire utilizes a conductor made up of either a helically wound metal conductor on a radio frequency insulating polymer overcoated on a polymer adhesive layer on a glass fiber bundle; or a glass fiber-cotton fiber braid on a graphite impregnated glass layer. Overcoating either one of the conductors is a semiconducting polymer layer, an ethylene-propylene-diene monomer containing polymer layer optionally overcoated with a glass braid layer and a polymer jacket material. The polymer jacket material comprises a polymeric mixture of ethylene vinyl acetate and ethylene-propylene-diene monomer stabilized with a mixture of a phenolic antioxidant and a metal salt antioxidant.

5 Claims, 4 Drawing Figures

IGNITION WIRE

TECHNICAL FIELD

The field of art to which this invention pertains is insulated electrical conductors, and specifically ignition wire.

BACKGROUND ART

In the electrical conductor art, in addition to electrical insulating properties, consideration is also given to physical properties provided by particular insulation material, and depending on the particular use such insulated wires are to be put, the physical property requirements can be quite demanding.

In the automotive area, for example with ignition wire, the physical requirements for the wire are particularly severe. In addition to insulating ability, the wire must be capable of extreme heat aging and oil resistance as well.

And of course, while extreme physical properties are obtainable, in view of the significant amounts of wire used for this purpose in the automotive industry, manufacturing costs can be a significant consideration.

Accordingly, there is a constant search in this art for insulating materials for automotive ignition wire which have the requisite combination of insulating properties, physical properties, and reasonable costs to produce.

DISCLOSURE OF INVENTION

The present invention is directed to a multilayer electrically conducting ignition wire having an improved jacketing material as the outermost layer. The wire comprises a glass fiber core coated with an adhesion layer, which is overcoated with a layer of thermally stable radio frequency suppressing insulating polymer. On top of the insulating polymer is helically wound a layer of electrically conducting wire. The electrically conducting wire is overcoated with a semiconducting polymer layer containing release agent. A layer of electrically insulating polymer is overcoated on the semiconducting polymer layer, upon which is then optionally braided a layer of glass fiber. Over top of the braided glass fiber layer (or insulating polymer layer if no braid is present) is applied improved jacketing material comprising a blend of ethylene-propylene-diene monomer with ethylene vinyl acetate, stabilized with a mixture of phenolic antioxidant and a metal salt antioxidant.

Another aspect of the invention is an improved ignition wire with the similar jacketing material, glass fiber braid, electricaly insulating polymer, and semiconducting polymer layers as recited above. However, in place of the helically wrapped wire, radio frequency suppressing insulating polymer layer, adhesion layer, and glass fiber bundle is used a conductor element comprising a graphite impregnated glass fiber bundle wrapped in a glass fiber braid layer.

The foregoing, and other features and advantages of the present invention will become more apparent from the following description and accompanying drawings.

BEST MODE FOR CARRYING OUT THE INVENTION

Figure 1:
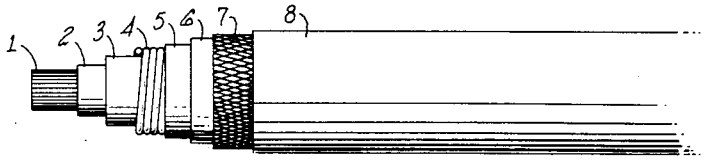
FIGS. 1 and 3 show a jacketed wire according to the present invention utilizing a helically wound linear wire for conductivity.
Figure 3:
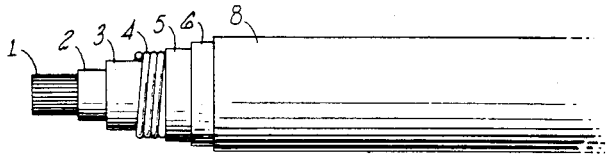

In FIGS. 1 and 3, the glass fiber bundle 1 is of the type conventionally used in this art and typically comprises sixteen strands per bundle of Jonathan Temple glass fiber ECG 150/4/16 (sixteen strands per bundle represents a typical OEM construction although fewer strands maybe used, e.g. twelve strands per bundle for a typical after-market construction). The primary purpose of the bundle is to provide a strength member base for the subsequently helically wrapped wire conductor 4 in FIG. 1.

Over this glass fiber bundle is applied a (dip coated) layer of adhesive 2 to improve the adhesion between the glass fiber bundle and the subsequently applied radio frequency suppressing insulating polymer layer 3. This adhesive is any conventional adhesion promoter such as Chemlok ® adhesive available from Hughson Chemicals. As stated, over this adhesive layer is provided a radio frequency suppressing insulating polymer which provides insulation between the glass fiber and the subsequently helically wrapped wire conductor 4. This polymer material is commercially available ethylene-propylene-diene monomer type material and contains conventional magnetic particles such as iron oxide to provide the radio frequency suppressing function. The material typically contains about 20% by weight of the particles.

Upon the insulating polymer layer is next helically wrapped a wire conductor. This wire is typically a high resistance metal such as commercially available nickel alloys (e.g. ESO 6015 available from Vereinigie Deutsche Metallwerke, A.G.). The number of turns per inch and the wire diameter size is dependent upon the resistance requirements of the particular wire, but typically 43 gauge (American Wire Gauge) wire is used with 120 turns per inch.

The next layer comprises a semiconducting polymer layer. This layer also contains release agents. The polymer is typically a thermoplastic polymer (such as silicone or acrylic polymer) for example commerically available from Acheson Colloids Company under the product designation ED580. The polymer contains conducting particles (for example carbon particles) and release agents (for example carbon particles or DuPont Teflon ® particles) to provide the release characteristics and semiconducting function. There should be sufficient release agents present to allow the subsequently applied layers to strip cleanly and sufficient semiconducting particles to reduce or eliminate any excessive voltage gradients which may occur due to imperfections (burrs, spikes, etc.) in the conductor itself.

On top of this semiconducting layer is applied the commercially available electrically insulating ethylene-propylene-diene monomer (EPDM containing polymer 6). In addition to the insulating properties provided by this layer upon cure, e.g. by continuous vulcanization (CV) tube, this layer can expand somewhat through the optionally present braid material 7 (in FIG. 1) subsequently applied and provide additional adhesion to the jacketing material 8. This will increase corona resistance between the insulation and jacket material. Over this EPDM layer is next applied a glass fiber braid layer. This material is also conventionally used in this art and is available, for example from Atkins-Pearse (150/1 10-2, at 14 picks per inch). This material provides mechanical reinforcement to the wire.

Figure 4:
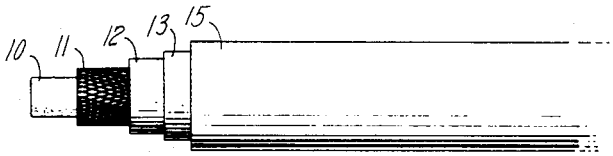

Another important advantage of the present invention, as is demonstrated by FIGS. 3 and 4, is that the braid layer (7 in FIG. 1 and 14 in FIG. 2) can be eliminated as shown in FIGS. 3 and 4. Although the braid layer does provide additional tensile strength to the respective articles, the improvement in adhesion of the jacket material to the EPDM containing polymer layers 6 and 13 can provide requisite tensile strength not available with other conventionally used materials (e.g. silicone).

The final layer is the polymer jacket layer. This layer comprises a mixture of ethylene-propylene-diene monomer with ethylene vinyl acetate (EVA) copolymer and a mixture of a phenolic antioxidant and a metal salt antioxidant. The ethylene-propylene-diene monomer typically comprises 68% ethylene, and 32% propylene with a small amount of nonconjugated diene termonomer for cross-linking. This material is commerically available from Uniroyal as Royalene TM 512. The ethylene vinyl acetate copolymer typically contains 40% by weight vinyl acetate and can be obtained from E.I. DuPont deNemours as Elvax TM 40. The EPDM provides electrically insulating properties, particularly low specific inductive capacity, high dielectric breakage voltage, and low dissipation factor, etc. The ethylene vinyl acetate provides physical properties such as high oil resistance. The ethylene vinyl acetate typically has a melt index of 48-66 (ASTM D1238). The EPDM is typically high viscosity, the diene component providing a cross-linking function and the ethylene component providing crystallinity, the overall blend being workable and typically having a viscosity of 60 Mooney (ML 1+4) at 125° C. The amount of vinyl acetate used can be less than the 40% with a sacrifice in some of the physical properties, such as oil resistance.

To produce a satisfactory blend of physical and electrical properties the EPDM and EVA polymers are typically used in about equal proportions. Natually one skilled in this art may vary from this ratio with concurrent decrease in either insulating or physical properties. The composition is typically mixed so as to have a viscosity of between 10 and 20 inch pounds at 380° F. using a Monsanto Rheometer with 3° arc at 900 cycles per minutes. This provides a composition suitable for extrusion application.

As stated above, the equal amounts (based on parts by weight) provides processability, oil resistance, heat resistance, and insulating properties suitable for commercial applications.

As the antioxidant any phenolic antioxidant and metal salt mixture can be used with a hindered alkylated phenol and zinc mercaptotolylimidazole being preferred (e.g. Ciba Geigy's Irganox 1035 and RT Vanderbuilt Vanox ZMTI or Mobay's ZMB-2 respectively).

Typically these materials are used at about 3.5% by weight based on total weight of the jacket material. The order of mixing of the components of the jacket material is not critical. Typically the materials are mixed in a size 11 Farrel mixer to about 75% loading capacity. The materials are mixed for about 10 minutes at room temperature and extruded typically at about 190° F. to about 200° F.

Figure 2:
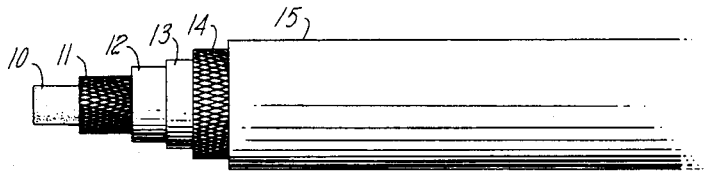
FIGS. 2 and 4 show a jacketed wire according to the present invention utilizing graphite impregnated glass as a conducting element.

FIGS. 2 and 4 are similar to FIGS. 1 and 3 insofar as the outermost layers in FIGS. 2 and 4 (numbered 12–15) are similar to the outermost layers in FIGS. 1 and 3 (numbered 5–8). The conductor 10 in FIGS. 2 and 4 is a glass fiber bundle impregnated with carbon particles, for example as is available from Jonathan Temple (as a 60 end 150/1/0 roving carbon impregnated glass). This material is particularly appropriate for use in those environments where less demanding voltage and temperature requirements are needed.

The glass braid 11 applied to the graphite impregnated glass is typically a mixture of interwoven cotton thread and glass used in equal amounts, as is conventionally used in this art.

The article of the type disclosed in FIGS. 1 and 3 is typically made by dip coating the adhesive out of a conventional solvent or water based solution using a conventional dip coating tower oven operation. The semiconducting layer, the EPDM layer and the jacket material are extruded using commercially available extrusion equipment such as a John Royal extruder. The semiconducting polymer layer applied to the coiled conductor is similarly dipped coated as described above. The optionally included glass fiber braid can be applied using commerically available braiding equipment such as a Wardwell braider. Similarly, the article shown in FIGS. 2 and 4 uses the same dip coating methods for appling the semiconducting polymer and the same type of braiding machines for the glass fiber braid layer.

EXAMPLE I

A Jonathan Temple ECG 150/4/16 strand glass fiber bundle was dip coated with a layer of Chemlok 234b adhesive. The adhesive was dried in a tower oven. Over the adhesive layer was extruded a layer of radio frequency insulating polymer comprising ethylene-propylene-diene monomer containing 20% by weight of 0.4 micron diameter iron oxide particles. The coated conductor was next overwrapped using a conventional wire winder with 43 gauge nickel alloy wire (Alloy C) spaced at 120 turns per inch. This was overcoated using a dip coating process and tower oven drying with a semiconducting polymer layer of thermoplastic polymer containing carbon black and Teflon particles. This is typically applied out of solution at about 12% solids by weight. Over the semiconducting polymer layer is next extruded a layer of ethylene-propylene-diene monomer containing polymer. This is overbraided (using a Wardwell braider) with 150/1/0-2 glass fiber (Atkins-Pearce Company) at 14 picks per inch. Finally, the jacket material (ethylene vinyl acetate containing 40% by weight vinyl acetate stabilized with 3.5% of a mixture of hindered alkylated phenol and zinc mercaptotolylimidazole at a ratio of 1:2) is extruded over the glass fiber using a John Royal 4.5 inch, 20/1 (length-/diameter) extruder. The jacketed conductor was then cured in a continuous vulcanization tube having a cure time in a 300 foot long tube of about 1.5 minutes at 250 psig steam pressure. The glass fiber bundle has a diameter of 52 mils and a layer approximately 1 mil thick of adhesive was coated on the glass fiber bundle. The amount of RF insulating polymer applied to the adhesive layer increased the diameter of the wire to 75 mils. The coil wrap increased this diameter to 79 mils, with about 1 mil thick semiconducting polymer subsequently applied. The extruded EPDM layer increased the diameter to 275 mils and the glass fiber braid layer increased the diameter to 278 mils. The extruded polymer jacket resulted in a wire with a 315 mil diameter.

EXAMPLE II

The method of Example I was repeated except that in place of the glass fiber bundle, adhesive layer, RF insulating polymer layer, and helically wrapped conductor layer a graphite impregnated glass overbraided with a glass fiber containing braid material was used. The graphite impregnated glass used was obtained from Jonathan Temple as 60N/150/1/0 carbon impregnated glass roving. The braid used to wrap the graphite impregnated glass was four carriers of 60-2-2 cotton thread and four carriers of 150/1/0-3 glass using a Wardwell braider for the operation. The graphite impregnated glass had a diameter of 75 mils after wrapping with the glass fiber braid. Approximately 1 mil thick coating was applied to the glass fiber braid and from that point on the diameter of the layered product paralleled that in Example I.

EXAMPLE III

The jacket material useful in Example I and Example II above has been made with the following composition.

| Materials | Parts | Wt. % |
|---|---|---|
| EPDM (Royalene 512) | 50 | 23.791 |
| Elvax 40 (EVA-40% by weight) | 50 | 23.791 |
| Zinc Oxide (Cure Activator) | 5 | 2.379 |
| Paraffin Wax (Processing Aid) | 5 | 2.379 |
| Low Molecular Weight Polyethene (Processing Aid, Allied AC617A) | 2 | 0.952 |
| Hydrated Alumina (Hydral 710) (High Temperature Filler) | 50 | 23.791 |
| Talc (Reinforcing Filler) | 30 | 14.275 |
| Coagent (Ware C 416) | 6.66 | 3.169 |
| Vinyl Silane (Adhesion Promoter) | 1 | 0.476 |
| Phenolic Antioxidant (Irganox 1035) | 3 | 1.427 |
| Metal Salt Antioxidant (ZMB-2) | 6 | 2.855 |
| Fatty Acid Salt (Processing Aid, Vanfre AP-2) | 1.5 | 0.715 |

The above composition is strained and screened to remove impurities and then mixed with a peroxide curing agent (Vulcup TM R, Hercules) at 2 parts by weight (0.93%) and various pigments added for color at 3 parts by weight (1.394%).

Various fillers, processing aids, coagents, curing agents, etc. can be added to the jacket material to aid in processing and curing. This includes such things as paraffin wax, polyethylene, vinylsilanes, peroxides, fillers such as talc and hydrated alumina, etc.

In addition to lower cost than conventional silicone jacket material used in this enviroment, the polymer jacket according to the present invention has at least a 275° F. SAE J557 rating and in fact the material shown in FIG. 1 has a 400° F. rating. Furthermore, the material has excellent electrical insulating properties, heat resistance, oil resistance, and abrasion resistance.

Although this invention has been shown and described with respect to detailed embodiments thereof, it will be understood by those skilled in the art that various changes in form and detail thereof may be made without departing from the spirit and scope of the claimed invention.

We claim:

1. Electrically conductive ignition wire comprising a glass fiber core overcoated with an adhesion promoting polymer layer, which is overcoated with a radio frequency insulating polymer, having helically wrapped thereon electrically conducting wire, which is overcoated with a layer of ethylene-propylene-diene monomer containing polymer, and a polymer jacket coated on the ethylene-propylene-diene monomer containing polymer layer, the polymer jacket comprising a mixture of ethylene-propylene-diene monomer containing polymer with ethylene vinyl acetate, stabilized with a mixture of phenolic antioxidant and a metal salt antioxidant.

2. Electrically conductive ignition wire comprising a graphite impregnated glass fiber core overbraided with a glass and cotton fiber braid, which is overcoated with a semiconducting polymer layer containing release agent, a layer of ethylene-propylene-diene monomer containing polymer coated on the semiconducting polymer layer, and a polymer jacket layer coated over the ethylene-propylene-diene monomer containing polymer layer, the polymer jacket comprising a mixture of ethylene-propylene-diene monomer containing polymer with ethylene vinyl acetate stabilized with a mixture of a phenolic antioxidant and a metal salt antioxidant.

3. The wire of claim 1 which additionally contains a layer of glass fiber braid between the ethylene-propylene-diene monomer containing polymer layer and the polymer jacket.

4. The wire of claim 2 which additionally contains a layer of glass fiber braid between the ethylene-propylene-diene monomer containing polymer layer and the polymer jacket.

5. The wire of claims 1, 2, 3 or 4 wherein the ethylene vinyl acetate polymer contains 40% by weight vinyl acetate and the antioxidant mixture is present in an amount of about 3.5% by weight and the weight ratio of phenolic antioxidant to metal salt antioxidant is about 1:2.

* * * * *

UNITED STATES PATENT AND TRADEMARK OFFICE

CERTIFICATE OF CORRECTION

PATENT NO. : 4,700,171

DATED : October 13, 1987

INVENTOR(S) : Ronald J. Coffey & Christo M. Wassouf

It is certified that error appears in the above-identified patent and that said Letters Patent is hereby corrected as shown below:

Title Page, Assignee: "United Technologies Corporation" should be--Essex Group, Inc.--.

Signed and Sealed this

Tenth Day of May, 1988

*Attest:*

*Attesting Officer*

DONALD J. QUIGG

*Commissioner of Patents and Trademarks*